US011612990B2

(12) United States Patent
Frenken

(10) Patent No.: US 11,612,990 B2
(45) Date of Patent: Mar. 28, 2023

(54) METHOD FOR OPERATING A HYDRAULICALLY OPERATED HANDHELD DEVICE, AND HYDRAULICALLY OPERATED HANDHELD DEVICE

(71) Applicant: GUSTAV KLAUKE GMBH, Remscheid (DE)

(72) Inventor: Egbert Frenken, Heinsberg (DE)

(73) Assignee: GUSTAV KLAUKE GMBH, Remscheid (DE)

( * ) Notice: Subject to any disclaimer, the term of this patent is extended or adjusted under 35 U.S.C. 154(b) by 1124 days.

(21) Appl. No.: 16/312,674

(22) PCT Filed: Jun. 8, 2017

(86) PCT No.: PCT/EP2017/063895
§ 371 (c)(1),
(2) Date: Dec. 21, 2018

(87) PCT Pub. No.: WO2018/001691
PCT Pub. Date: Jan. 4, 2018

(65) Prior Publication Data

US 2020/0147772 A1 May 14, 2020

(30) Foreign Application Priority Data

Jun. 29, 2016 (DE) ..... 10 2016 111 874.5

(51) Int. Cl.
*B25B 27/10* (2006.01)
*B21J 15/20* (2006.01)
(Continued)

(52) U.S. Cl.
CPC ..... *B25B 27/10* (2013.01); *B21D 28/34* (2013.01); *B21J 15/20* (2013.01); *B25F 5/005* (2013.01); *B26F 1/44* (2013.01); *H01R 43/0427* (2013.01)

(58) Field of Classification Search
CPC ..... Y10T 29/53909; H01R 43/0427; H01R 43/042; B26F 1/34; B25F 5/005;
(Continued)

(56) References Cited

U.S. PATENT DOCUMENTS 3,817,152 A 6/1974 Viron
5,727,417 A 3/1998 Moffatt et al.
(Continued)

FOREIGN PATENT DOCUMENTS

DE 2211288 A1 9/1972
DE 3710863 12/1995
(Continued)

OTHER PUBLICATIONS

International Search Report for corresponding international patent application No. PCT/EP2017/063895 dated Oct. 19, 2017, 7 pages.
(Continued)

*Primary Examiner* — Tyrone V Hall, Jr.
(74) *Attorney, Agent, or Firm* — Klintworth & Rozenblat IP LLP

(57) ABSTRACT

A hydraulically operated handheld device and a method of operating same are provided. The device includes a hydraulic pump, a moving part, a fixed part and a return valve with an associated valve seat. The moving part is moved into a working position due to the buildup of a hydraulic pressure by filling a hydraulic chamber with hydraulic medium from a reservoir with the aid of the hydraulic pump. The moving part can be automatically moved back from the working position into an end position upon reaching a predefined working pressure by opening the return valve. The hydraulic pressure acting upon the return valve is increased by a separately triggerable pressure increase, which results in opening of the return valve, in a hydraulic medium volume located upstream of the return valve in a flow direction of the
(Continued)

hydraulic medium during the movement into the end position.

20 Claims, 11 Drawing Sheets

(51) Int. Cl.

| | |
|---|---|
| ***H01R 43/042*** | (2006.01) |
| ***B21D 28/34*** | (2006.01) |
| *B25F 5/00* | (2006.01) |
| *B26F 1/44* | (2006.01) |

(58) Field of Classification Search
CPC ..... B25F 5/00; B25B 27/02; B25B 27/026; B25B 27/10; B23P 19/02; B23P 19/027
See application file for complete search history.

(56) References Cited

U.S. PATENT DOCUMENTS

| | | | |
|---|---|---|---|
| 6,276,186 | B1 | 8/2001 | Frenken |
| 6,401,515 | B2 | 6/2002 | Frenken |
| 6,769,356 | B2 | 8/2004 | Frenken |
| 7,032,296 | B2 | 4/2006 | Zdravkovic et al. |
| 7,908,963 | B2 | 3/2011 | Frenken |
| 8,056,473 | B2 | 11/2011 | Frenken |
| 2005/0016375 | A1 | 1/2005 | Harwath et al. |
| 2005/0235730 | A1 | 10/2005 | Brailovskiy |
| 2009/0133591 | A1 | 5/2009 | Frenken |
| 2012/0160065 | A1* | 6/2012 | Frenken ..... B21J 15/20 81/57.44 |
| 2013/0206022 | A1 | 8/2013 | Bungter |
| 2015/0364889 | A1 | 12/2015 | Frenken |

FOREIGN PATENT DOCUMENTS

| | | | |
|---|---|---|---|
| DE | 102008028957 | | 12/2009 |
| EP | 0944937 | | 3/2002 |
| EP | 1249619 | A1 | 10/2002 |
| EP | 1564461 | A1 | 8/2005 |
| WO | WO2007018649 | A1 | 2/2007 |
| WO | 2007/141156 | | 12/2007 |
| WO | WO2008138987 | A2 | 11/2008 |
| WO | WO2010123987 | A1 | 10/2010 |
| WO | 2011/000907 | | 1/2011 |
| WO | WO2011061212 | A1 | 5/2011 |
| WO | WO2012055901 | A1 | 5/2012 |
| WO | 2014/108361 | | 7/2014 |

OTHER PUBLICATIONS

Written Opinion for corresponding international patent application No. PCT/EP2017/063895 dated Oct. 19, 2017, 8 pages.
Machine Translation of DE 3710863A1.
Machine Translation of DE 102008028957A1.
Machine Translation of WO 2007141156A1.
Machine Translation of WO 2011000907A1.
Machine Translation for EP1249619 (A1).
Machine Translation for WO2008138987 (A2).
Machine Translation for WO2011061212 (A1).
Machine Translation for WO2012055901 (A1).

* cited by examiner

METHOD FOR OPERATING A HYDRAULICALLY OPERATED HANDHELD DEVICE, AND HYDRAULICALLY OPERATED HANDHELD DEVICE

TECHNICAL FIELD

The invention initially pertains to a method for operating a hydraulically operated handheld device, for example a pressing device and/or a hole-punching or punching device, wherein the handheld device comprises a hydraulic pump, a moving part, a fixed part and a return valve with an associated valve seat, wherein the moving part is moved into a working position due to the buildup of a hydraulic pressure, which is realized by filling a hydraulic chamber with hydraulic medium from a reservoir with the aid of the hydraulic pump, and wherein the moving part can be automatically moved back from the working position into an end position upon reaching a predefined working pressure by opening the return valve.

The invention furthermore pertains to a hydraulically operated handheld device, for example a pressing device and/or a hole-punching or punching device, wherein the handheld device comprises a hydraulic pump, a moving part, a fixed part and a return valve with an associated valve seat, wherein the moving part can be moved into a working position due to the buildup of a hydraulic pressure, which is realized by filling a hydraulic chamber with hydraulic medium from a reservoir with the aid of the hydraulic pump, and wherein the moving part can be automatically moved back from the working position into an end position upon reaching a predefined working pressure by opening the return valve.

PRIOR ART

Methods and handheld devices of this type are known, for example, from DE 10 2008 028 957 A1, EP 0 944 937 B1 (U.S. Pat. No. 6,276,186 B1, U.S. Pat. No. 6,401,515 B2) and WO 2014/108361 A1.

Such handheld devices are used, for example, as pressing devices, preferably for compressing or crimping cable lugs with inserted cables or for compressing tubular work pieces. Handheld devices of this type may also be used for hole-punching or punching processes, particularly on metal components. Furthermore, such handheld devices may also be realized in the form of riveting devices or other cutting devices.

A hydraulically operated handheld device in the form of a pressing device is described, for example, in EP 0 944 937 B1 (U.S. Pat. No. 6,276,186 B1, U.S. Pat. No. 6,401,515 B2). This handheld device comprises a return valve, which upon reaching a predefined hydraulic pressure moves into an open valve position and is held in this position. This leads to a backflow of the hydraulic medium that moves the moving part into the working position. The moving part moves back into the home position or end position due to the respectively lacking or reduced pressure acting thereupon. The hydraulic pressure acting upon the return valve is no later than upon reaching this end position lowered to such a degree that the return valve once again closes automatically.

SUMMARY OF THE INVENTION

Based on the above-cited prior art, the invention aims to respectively disclose a method for operating a hydraulically operated handheld device and a hydraulically operated handheld device, which respectively allow the processing and simplify the handling of workpieces that particularly differ with respect to their size and/or material with a simple design of the device.

According to a first inventive idea, this objective is potentially attained with a method, in which the hydraulic pressure acting upon the return valve for triggering a movement of the moving part into the end position is increased by means of a separately triggerable pressure increase, which results in opening of the return valve, in a hydraulic medium volume located upstream of the valve seat of the return valve in a flow direction of the hydraulic medium during the movement into the end position.

With respect to the hydraulically operated handheld device, it is accordingly proposed that the hydraulic pressure acting upon the return valve for triggering a movement of the moving part into the end position can be increased by means of a separately triggerable pressure increase, which results in opening of the return valve, in a hydraulic medium volume located upstream of the valve seat of the return valve in a flow direction of the hydraulic medium during the movement into the end position.

According to another embodiment, it is proposed that the hydraulic pressure acting upon the return valve respectively is or can be decreased by means of a separately triggerable pressure decrease, which results in closing of the return valve, in a hydraulic medium volume located upstream of the valve seat of the return valve in a flow direction of the hydraulic medium during the movement into the end position.

The characteristic features of the above-described independent claims are essential to the invention individually, as well as in any combination with one another, wherein characteristic features of an independent claim can be combined with the characteristic features of another independent claim or with the characteristic features of multiple independent claims, as well as with only individual characteristic features of one or more of the other independent claims.

The predefined working pressure is the hydraulic pressure being adjusted in the hydraulic medium by a working process, at which the return valve moves into the open position due to its constructive design. When the return valve is closed, this hydraulic pressure is adjusted in the hydraulic chamber that extends from the moving part up to a closing surface of the return valve. The constructive design is preferably defined in that a partial piston area of a valve piston is in the closed state seated in the valve seat with a defined force, which is generated, e.g., by a spring acting upon the valve piston with a defined force in the closed state, and thereby forms the aforementioned closing surface. In this case, a defined hydraulic pressure is required for lifting the return valve off the valve seat by acting upon this partial piston area such that hydraulic medium can flow out, for example into a hydraulic medium reservoir, through the valve seat. Furthermore, the return valve in the form of a valve piston is preferably realized in such a way that it has an overall piston area, upon which the hydraulic medium acts when the return valve is lifted off the valve seat, i.e. in its open position. Due to the size ratio between the overall piston area and the partial piston area, a comparatively very low pressure of the hydraulic medium against the partial piston area may in the open position of the return valve suffice for holding the return valve in its open position. The area, which supplements the partial piston area so as to form the overall piston area, can also be acted upon by the hydraulic medium in the closed state of the return valve. However, it is not acted upon by the hydraulic medium, which is contained in the hydraulic chamber ending at the aforementioned closing surface and therefore located upstream of the return valve in the flow direction of the hydraulic medium during the movement into the end position, but rather, for example, by a separate hydraulic medium volume. In a practical implementation, for example, a pressure against the partial piston area between 300 and 600 bar, particularly 400 or 500 bar, may be required for lifting the return valve off the valve face whereas the overall piston area only requires a pressure of a few bar, for example 5 or 4 bar or less, e.g., a pressure as low as 0.5 bar, for remaining in the open position. In a concrete embodiment, this pressure acting upon the overall piston area may be generated, for example, by a return spring acting upon the moving part.

The predefined working pressure as such may also be adjustable, for example by adjusting the spring force acting upon the valve piston in the closed state. To this end, the spring may be additionally compressed or relaxed. This can be achieved, for example, with a set screw that acts upon the spring.

In an embodiment of the handheld device in the form of a hole-punching or punching device, the predefined working pressure is typically chosen higher than the pressure required for carrying out the hole-punching or punching process. In this respect, the predefined working pressure may also be adjusted so high that the return valve merely operates in the form of a pressure control valve without additional measures. The same basically applies, for example, to the design of a handheld device in the form of a riveting device. Alternatively, the design of the handheld device, particularly in the cited exemplary variations, may also be realized in such a way that the moving part moves back as far as its predefined home position when the return valve is triggered due to the predefined working pressure as long as no additional intervention takes place.

According to the presently described invention, a hydraulic pressure, at which the return valve is moved into the open position, can be achieved by increasing the pressure in the hydraulic medium volume acting upon the return valve with an actuation means that operates independently of a working process being carried out with the handheld device. This pressure increase takes place in the hydraulic medium volume that acts upon the partial piston area of the return valve in the closed state of the return valve. If applicable, the pressure effect may take place for a short time. The pressure increase is chosen such that the return valve is thereby moved into the open position. In this case, pressure in the hydraulic medium acting upon the moving part typically has not yet reached the predefined working pressure for enabling the moving part to carry out the working process. Consequently, the return valve can be hydraulically opened before the predefined working pressure, which corresponds to the triggering pressure of the return valve, is applied to the moving part.

The return valve can be hydraulically moved into the open position independently of a permanently adjusted maximum working pressure that actually acts upon the moving part.

The return valve preferably only closes after a defined hydraulic pressure acting upon the return valve has dropped to such a degree that the pressure required for holding the return valve in the open position due to the constructive design of the return valve is no longer reached.

The return valve can be automatically opened at a modifiable working pressure, i.e. at a preselected working pressure that is modified in comparison with the predefined working pressure, preferably as a result of a corresponding pressure acting upon the return valve.

The working pressure, which is—only—reached during a working process, can thereby also be adjusted in the form of a modified working pressure. For example, an adjusting wheel or buttons on the device enable the user to predefine a working pressure in the form of a modified working pressure, which is lower than the maximum permissible working pressure, i.e. the aforementioned predefined working pressure, at which the return valve preferably also opens automatically, or corresponds to the maximum working pressure. The latter may be sensible, for example, if the aforementioned maximum working pressure should actually, but also exclusively, be reached with greater accuracy. At a predefined or maximum working pressure of 600 bar, for example, it is possible to selectively adjust working pressures of 50 to 600 bar continuously or incrementally. This makes it possible to respectively adapt the pressure to the processing of workpieces to be carried out by means of the device while maintaining an automatic return movement of the moving part into the end position after the potentially adjusted working pressure is reached.

It would also be conceivable that the adjustment of the modified working pressure can be carried out from outside the handheld device, for example via a radio interface or optical interface.

The pressure increase preferably is only effective briefly. In terms of time, the pressure increase may only be effective for a few milliseconds, e.g. for a period of 2 to 5 ms.

The pressure increase is particularly realized by introducing hydraulic medium into the line section, which is arranged upstream of the valve seat with respect to an outflow direction of the hydraulic medium. This line section is prior to opening of the return valve defined by the partial piston area of the return valve on the one hand and by the piston area of the moving part on the other hand.

Due to the additional pressure load upstream of the valve seat in the backflow direction of the hydraulic medium, an initial pressure increase for moving the return valve into the open position essentially acts upon only the partial piston area of the return valve. It therefore also acts essentially decoupled from the moving part because this moving part is at the moment of the pressure increase still—only—subjected to the hydraulic pressure "upstream" of an actuation means initiating the pressure increase (with respect to the flow direction of the hydraulic medium through the opened return valve).

The initial pressure increase to a triggering pressure of the return valve, e.g. 600 bar, preferably lifts a piston of the return valve off the valve seat, whereupon a backflow opening for the hydraulic medium is released in accordance with the prior art and the returning hydraulic medium acts upon the piston area of the return valve, which is enlarged in comparison with the valve seat area, i.e. the partial piston area, and therefore also holds the return valve in the open position under reduced pressure or decreasing pressure, respectively. The pressure increase for reaching the triggering pressure therefore is preferably only effective for a very limited (referred to as initial) time period, which only has to be as long as necessary for lifting the piston of the return valve off the sealing position.

The pressure increase can be realized by blocking or restricting (e.g. cross-sectionally reducing) the line section in a region upstream of the return valve in the backflow direction of the hydraulic medium. This can be realized, e.g., with a displaceable closing element that acts like a slide or a valve tip.

A blocking means, which can be displaced in a triggerable manner, is preferably provided for restricting or blocking the line section. The blocking means may be realized in the form of a closing means that is actuated by a magnet, particularly an electromagnet, and preferably spring-loaded in the direction of a flow-through position.

In order to realize the pressure increase, hydraulic medium is introduced, preferably pumped, into the portion of the line section that results between the blocking means and the return valve and is referred to as second line section below.

When the blocking means is opened, the introduced hydraulic medium causes the desired linear displacement of the moving part. In the blocking position, in contrast, the hydraulic medium volume acting upon the moving part is preferably separated from the second line section, which continues to be supplied with hydraulic medium. In this way, the resulting pressure increase preferably acts exclusively upon the partial piston area of the return valve.

If the blocking means is realized in the form of a preferred magnetic valve, the force progression over the course of the closing process is preferably chosen such that the highest force is reached toward the end, i.e. shortly before closing.

In order to achieve an initial pressure increase, the line section is abruptly blocked or restricted. This can be realized manually by the user, e.g. with a correspondingly configured lever arrangement. However, an electromagnetic displacement of a valve, e.g. a linear displaceable magnetic valve, is preferred in this respect.

In a potential embodiment, the return movement of the moving part into the end position particularly can be stopped deliberately. This allows a faster reset of the device into an operational readiness position.

As the return movement is stopped, the pressure acting upon the return valve via the hydraulic medium also drops below the pressure value that holds the return valve in the open position. The return valve therefore automatically drops into the closed position.

A blocking or at least restricting effect, e.g. of a blocking means, in the above-described line section makes it possible to stop the return movement of the moving part and to achieve a pressure decrease in the region of the line section between the blocking means and the return valve (second line section), wherein said pressure decrease leads to a displacement of the return valve into the closed position.

If the blocking means is triggered, e.g., at a pressure of 300 bar, the pressure in the (first) line section between the blocking means and the moving part is maintained, in this example at 300 bar. However, the pressure in the second line section between the blocking means and the return valve increases in a virtually abrupt manner to the triggering pressure for the return valve, e.g. 600 bar. As a result, hydraulic medium is additionally introduced (pumped) into this line section. Subsequently, the pressure in the second line section once again drops.

A pressure sensor may be provided in the region of the second line section in order to detect when the pressure drop in the second line section is sufficiently high for the blocking means to open again. A pressure sensor may alternatively or additionally also be arranged in the first line section or directly assigned to the hydraulic medium. When the blocking means is actuated, the pressure sensor arranged in the second line section is correspondingly decoupled from the pressure in the hydraulic chamber and only measures the—briefly and as a rule significantly—increasing pressure in the second line section. If the termination of the blocking state occurs automatically as it is the case in preferred embodiments and described in greater detail further below, a pressure sensor in the second line section is also dispensable. In this case, the march of pressure in the hydraulic chamber can be continuously tracked with the pressure sensor in the first line section.

It would also be conceivable that a return movement of the moving part is triggered in dependence on a pressure value measured by the pressure sensor, in response to which the return valve is automatically opened, and that the working pressure, at which opening of the return valve is triggered, is adjustable in the above-described manner.

Due to the adjustability of the respective hydraulic pressure or working pressure, with which a workpiece or the like is acted upon by the moving part, an adaptation, for example, to the workpiece conditions can be very easily realized, particularly by the user. For example, softer and therefore easily deformable materials can be acted upon with a lower working pressure or hydraulic pressure than harder materials. In this way, workpieces with different parameters can be processed with only one handheld device.

The adjustable working pressure makes it possible to select a working pressure that deviates from the pressure in the hydraulic medium, at which the return valve would be moved into its open position anyway due to its constructive design. In this respect, we refer to the preceding explanations. This pressure, at which the return valve is moved into the open position due to its constructive design, is referred to as the predefined working pressure. However, the selected, adjusted working pressure may also correspond to the aforementioned predefined working pressure as already described above. The predefined working pressure remains unchanged regardless of the selected working pressure. A selected working pressure is not an issue as long as it lies below the predefined working pressure or corresponds thereto.

An adjusting device for different selectable working pressures may be provided. This adjusting device may be realized in the form of an adjusting wheel or adjusting slide or alternatively in the form of an assembly of multiple buttons, wherein each button is assigned to a predefined working pressure. An assembly of buttons can also be provided with a corresponding display. If applicable, an adjustment of the selectable working pressure can alternatively or additionally also be realized by means of a non-mechanical interface, particularly a radio and/or optical interface to the device.

With respect to the display, it would also be possible to show information that reflects the actually selected working pressure.

In addition, it is preferably also possible to trigger a return movement of the moving part at the same time the user stops acting upon a hand-actuated switch of the handheld device. The hand-actuated switch is the switch, which has to be actuated, particularly pressed, by a user in order to begin and (further) carry out a working process.

If the return movement of the moving part is triggered by stopping to act upon the switch as it is the case in preferred embodiments, it would furthermore be conceivable to terminate the return movement of the moving part with a repeated actuation. This can be realized, in particular, by (once again) blocking or restricting the line section upon a repeated actuation, for example by (once again) applying an electric voltage to the magnetic valve for blocking the line section. The resulting pressure drop in the second line section between the blocking region and the return valve then causes the return valve to close.

Consequently, not only a termination of the forward movement of the moving part, but also a return movement thereof in the direction of a home position, is realized by stopping to act upon the switch, particularly by releasing the switch that is usually realized in the form of a pushbutton.

The return movement may be realized by displacing the return valve that opens upon reaching a predefined working pressure into an open position with one of the above-described measures, which in turn leads to a backflow of the hydraulic medium acting upon the moving part.

On the other hand, the return valve may also be opened mechanically, e.g. electromechanically, for example in dependence on the detection of a stop of the actuation of the switch. In this case, the return valve is directly acted upon, e.g., by means of a rod assembly, for example by means of a corresponding piston rod if the return valve is realized in the form of a valve piston.

The actuation of the switch can be detected with corresponding sensors. It is also possible, for example, to monitor the motor current of a drive that drives the hydraulic pump. This particularly applies to instances, in which the operation of the hydraulic pump is directly dependent on the actuation of the switch. A discontinuance of the corresponding motor current is evaluated as a stop of the actuation of the switch.

A signal for opening the return valve can be generated.

The return valve can furthermore be opened by increasing the hydraulic pressure acting upon the return valve as it is the case in preferred embodiments. In this respect, we refer to the preceding explanations.

It would also be conceivable, for example, that the return movement of the moving part as a result of a corresponding switch actuation, particularly a stop of the actuation of the hand-actuated switch, only takes place if an initial workpiece contact was previously detected by the device.

This can be realized by providing a corresponding contact sensor or proximity sensor. The motor current of the pump drive may also be monitored for this purpose. Alternatively or additionally, the signal of a pressure sensor that measures the pressure in the hydraulic medium may be evaluated.

If a return movement should take place, for example, during the course of a pressing, cutting or punching process for certain reasons, e.g. in case of an emergency, it suffices to merely release the actuating switch. Subsequently, the moving part not only stands still, but rather also carries out a return movement.

The return valve can also be displaced into the open position in order to trigger the return movement of the moving part, for example, by means of a piston rod that is directly connected to a valve piston as described above or by means of a similar rod assembly, wherein a servomotor respectively acts upon said piston rod or rod assembly.

It would furthermore be conceivable that a complete return movement of the moving part initially has to take place before the next actuation is released. For example, a fixed time period of 5 or 10 seconds may be predefined in this respect. Alternatively, the pressure sensor also makes it possible to determine whether the return movement has (completely) taken place.

An (additional) option for acting upon the return valve with hydraulic pressure in order to trigger a movement of the moving part back into the end position allows an energy-efficient operation. Since the device as a whole does not necessarily have to operate until the triggering pressure of the return valve is reached, but the return movement rather can be purposefully initiated once the intended processing has taken place, an accumulator-operated handheld device with a charged accumulator is capable of carrying out considerably more processing cycles than solutions, in which the fixed triggering pressure always has to be reached during each working process.

In the known solutions, the deactivation may not always take place at the desired pressure despite a provided pressure sensor. For example, if the desired pressure is 230 bar, a pressure, e.g., of 300 bar can still develop due to corresponding inertia. However, a deactivation at a certain pressure, e.g. at the aforementioned 230 bar, is particularly important in connection with punch rivets because an excessive compression of the rivet could otherwise take place depending on the material. Due to the brief pressure increase acting upon the return valve, a fast pressure drop takes place on the moving part as a result of opening the return valve. The reaction, i.e. opening of the return valve, takes place within a time range of one or a few milliseconds. This time range may extend over a few milliseconds, for example two, four or five milliseconds.

BRIEF DESCRIPTION OF THE DRAWINGS

The invention is described in greater detail below with reference to the attached drawings, which merely show an exemplary embodiment. In the drawings.

DESCRIPTION OF THE EMBODIMENTS

Figure 1:
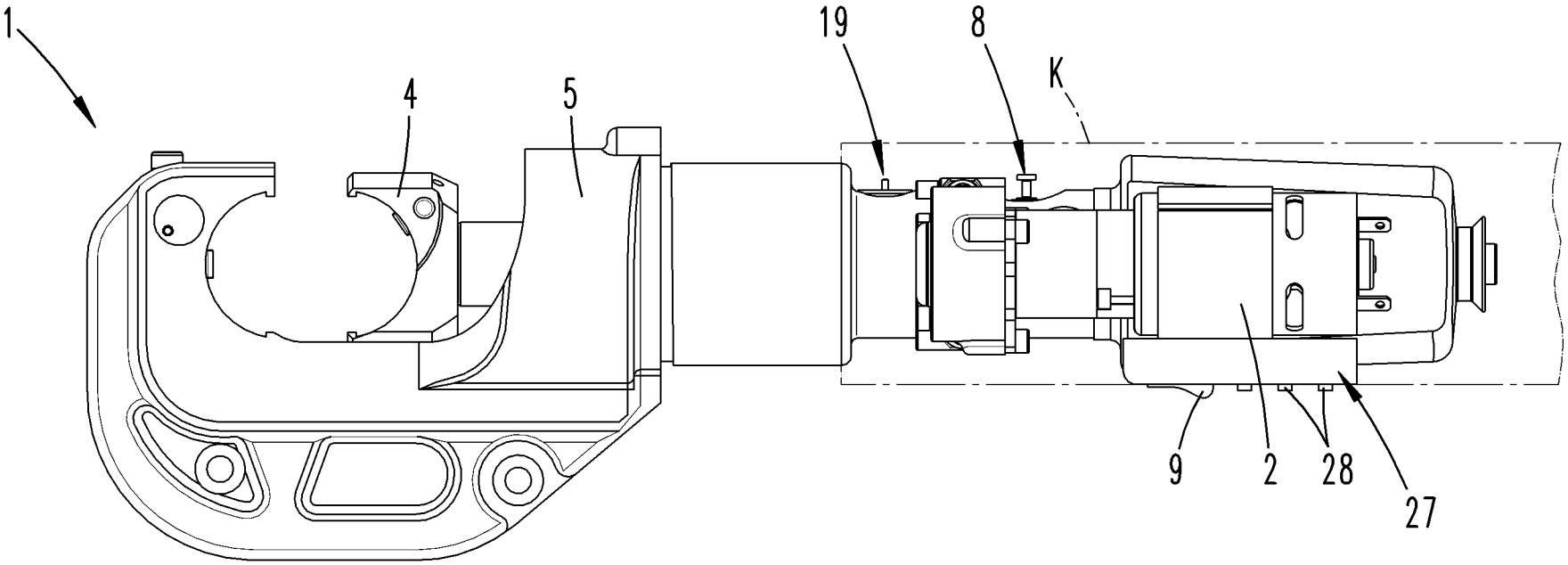
FIG. 1 shows a general view of a hydraulically operated handheld device in the form of a pressing device concerning a first embodiment.
Figure 2:
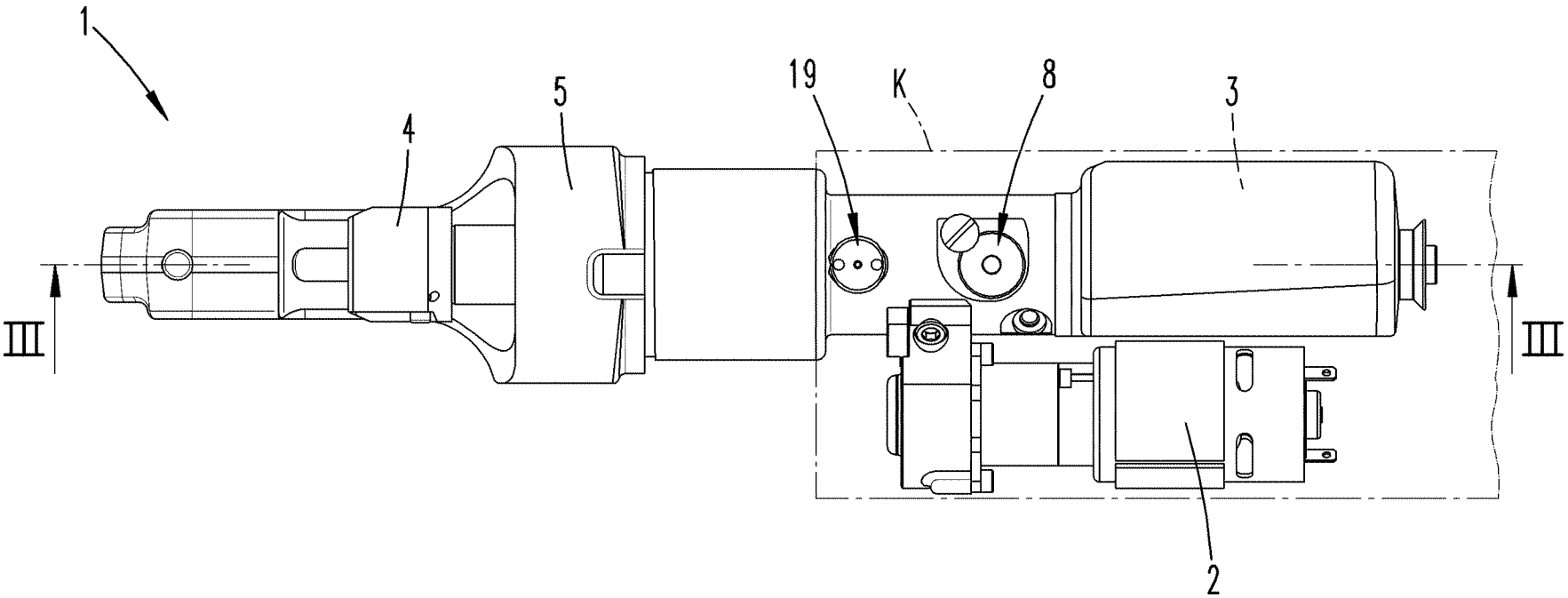
FIG. 2 shows a top view of the handheld device.

A hydraulically operated handheld device 1 in the form of a pressing device with an electric motor, 2, a not-shown hydraulic pump, a hydraulic medium reservoir 3 and a moving part 4 in the form of a hydraulic piston is initially described with reference to FIG. 1.

Figure 3:
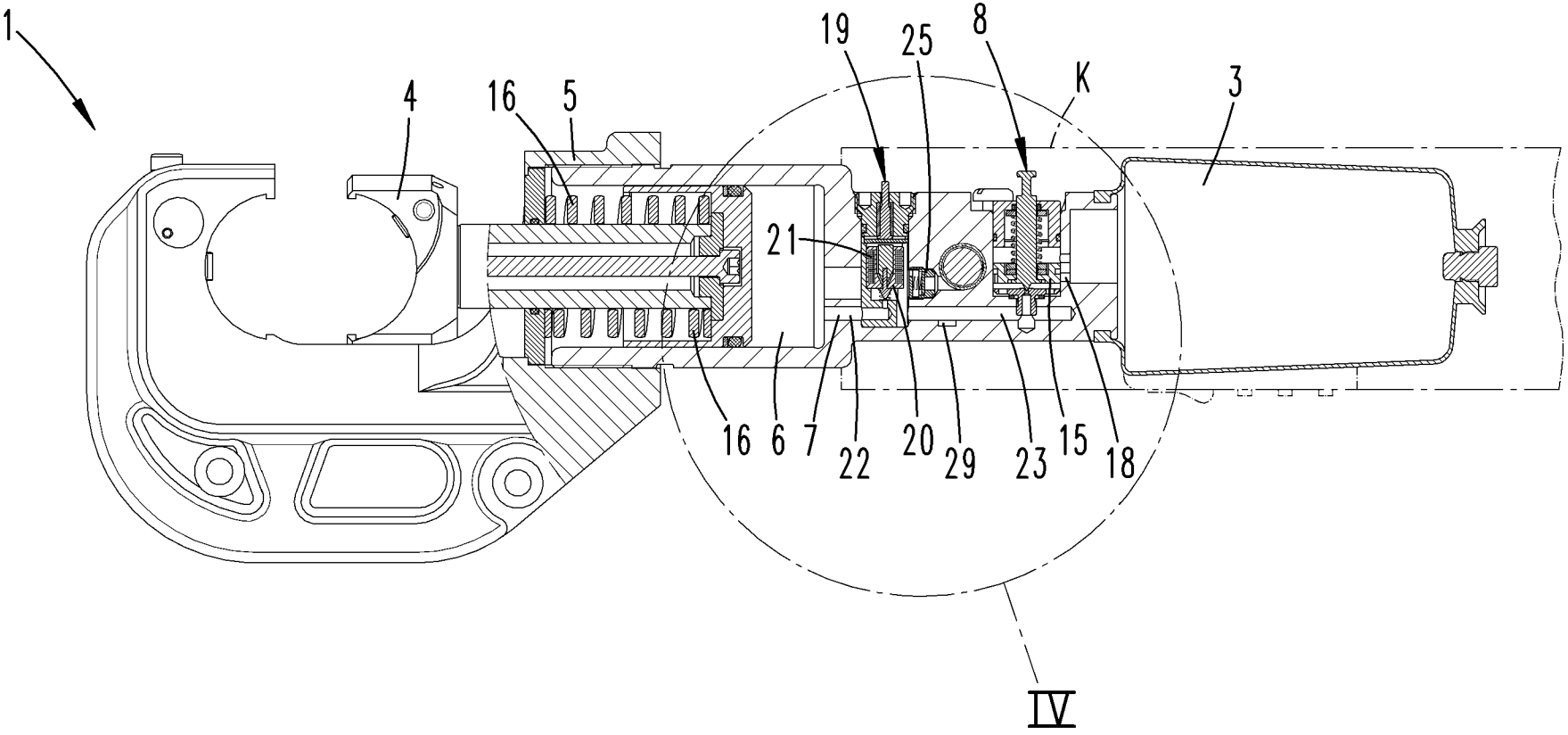
FIG. 3 shows an illustration corresponding to FIG. 1, however, in a partially exposed manner.

The moving part 4 can be moved relative to a fixed part 5, which is respectively formed by the device housing or, for example, the cylinder, in which the hydraulic piston moves. For example, the moving part 4 forms the tool receptacle illustrated in FIG. 1. It may also be realized, for example, in the form of a hydraulic piston (see for example FIG. 3).

Particularly the hydraulic medium reservoir 3, the return valve 8, the blocking means 19, the adjusting device 27 and, if applicable, other components are accommodated in a device body K that is not illustrated in greater detail in the figure.

The hydraulic chamber 6 comprises the space, into which hydraulic medium is pumped. This space begins on the pressure side of the hydraulic pump. According to FIG. 3, for example, the hydraulic chamber 6 comprises a return line 7, through which the hydraulic medium can flow back into the hydraulic medium reservoir 3 via a return valve 8.

Figure 4:
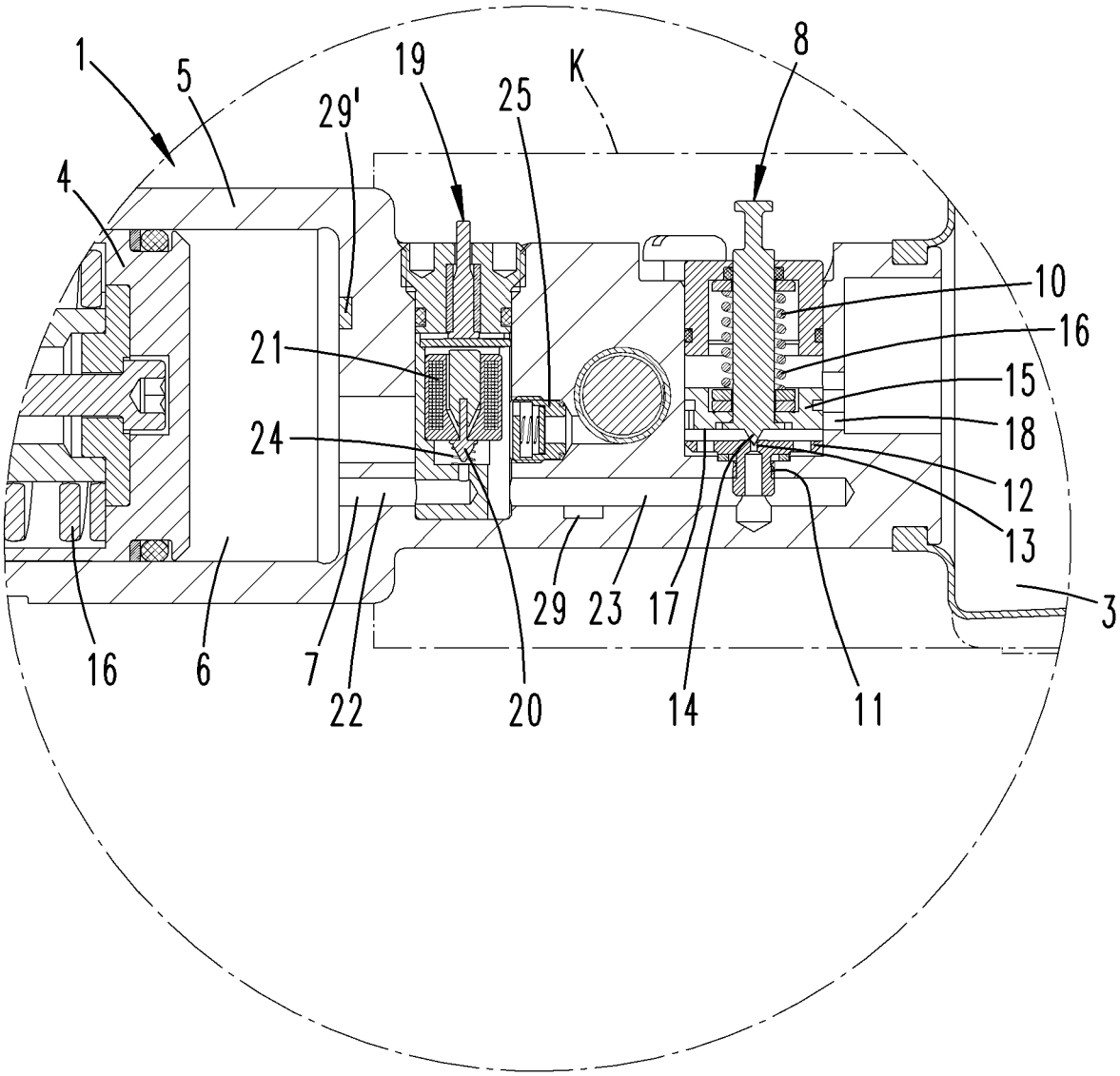
FIG. 4 shows an enlarged detail of the region IV in FIG. 3.
Figure 6:
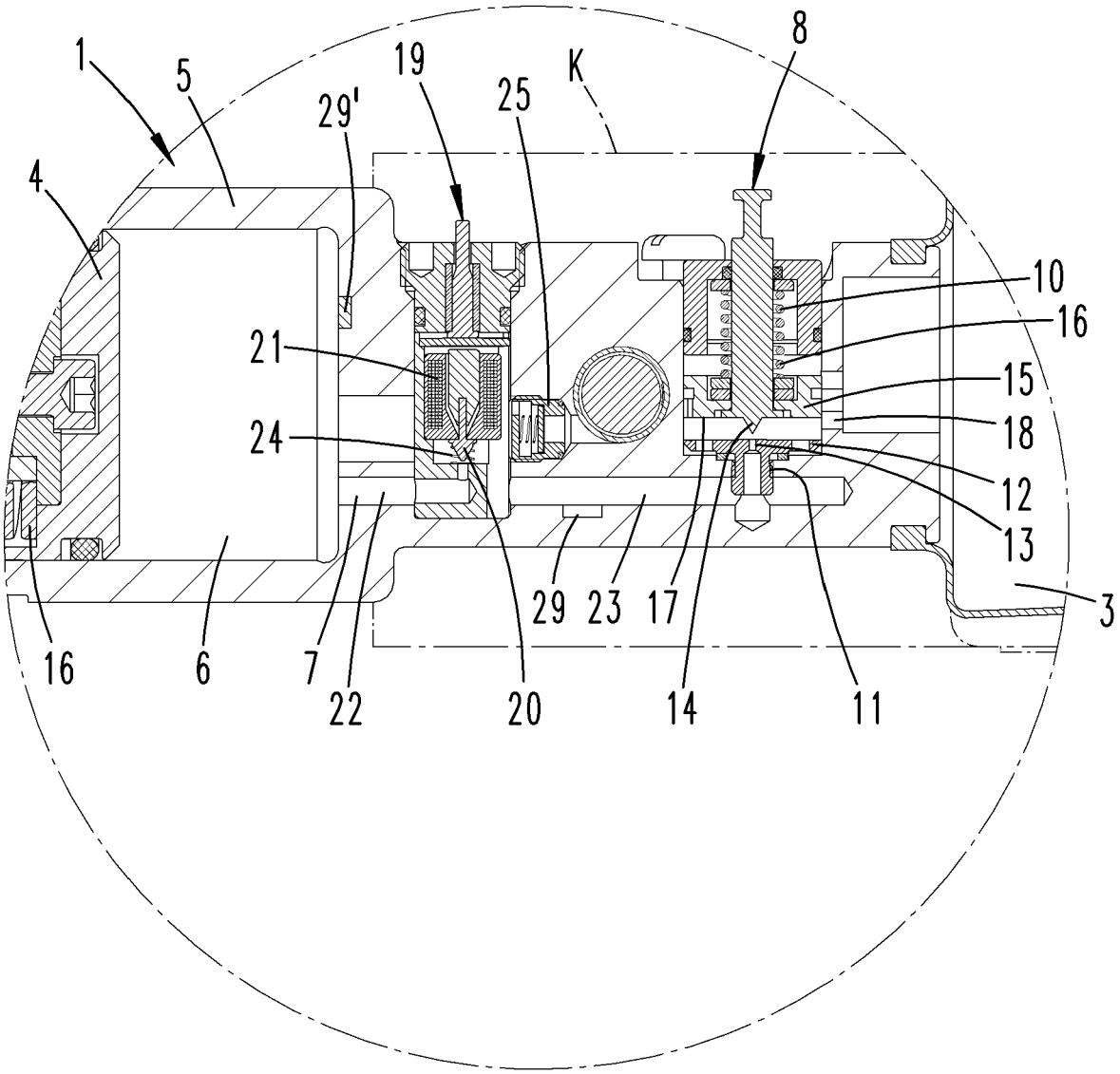
FIG. 6 shows an illustration corresponding to FIG. 4 with opened blocking means and opened return valve.
Figure 7:
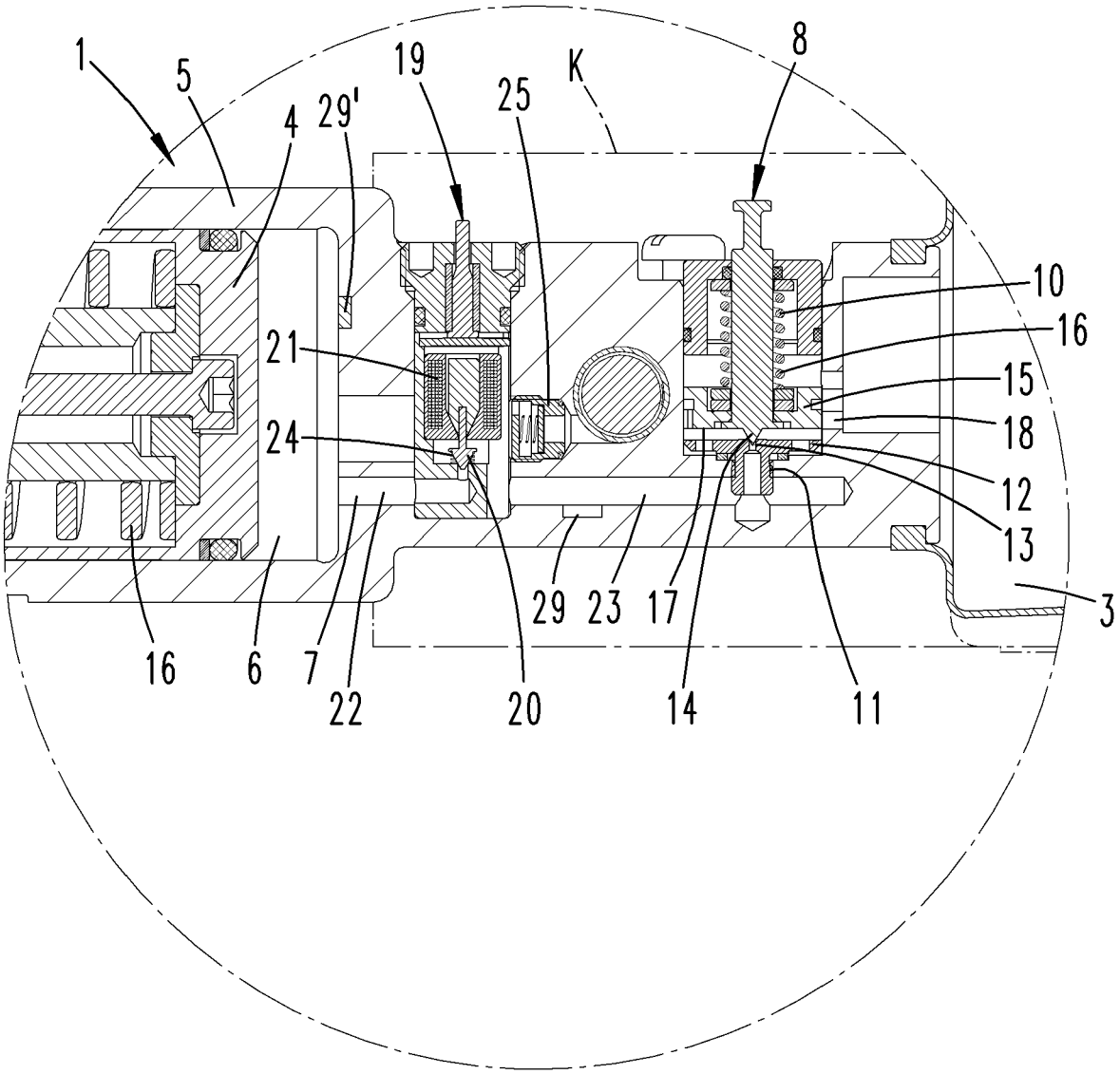
FIG. 7 shows a follow-up illustration to FIG. 6 after stopping a return movement of the moving part into a home position by closing the blocking means.
Figure 8:
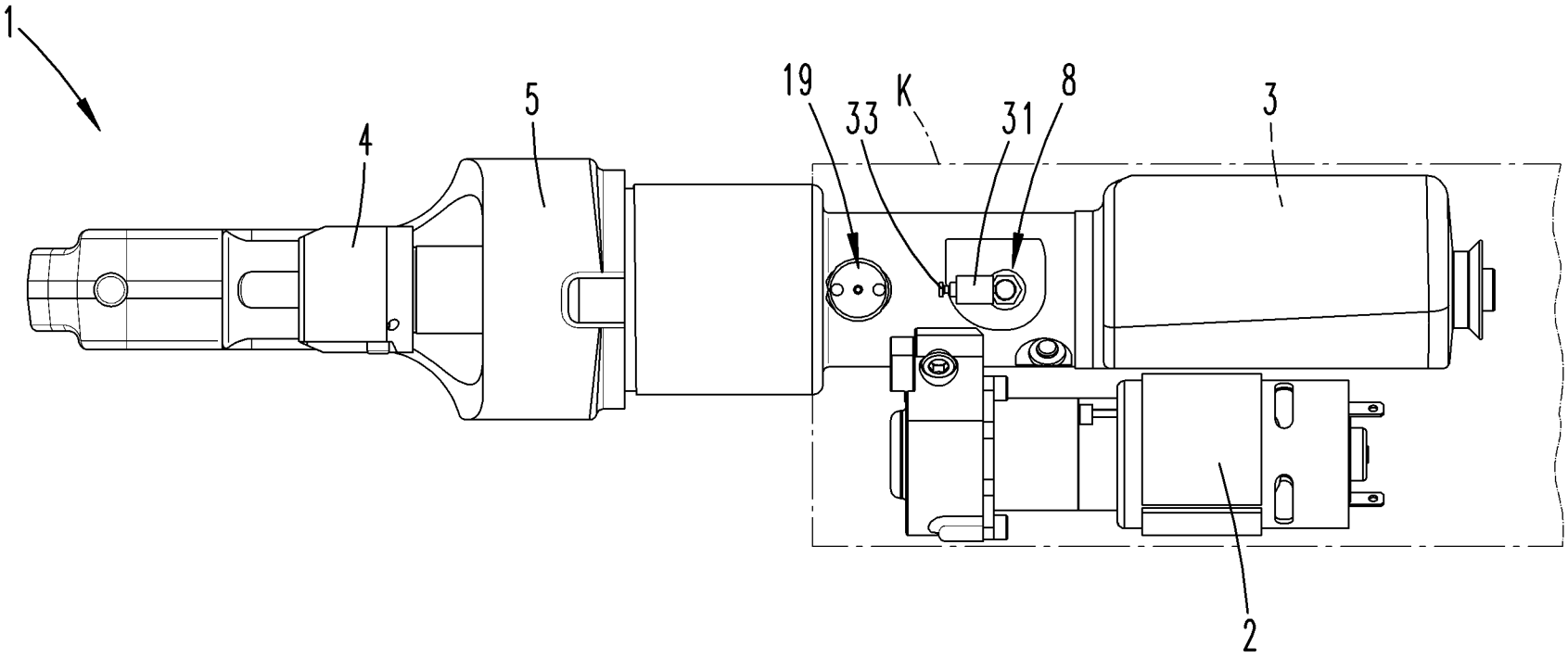
FIG. 8 shows an illustration corresponding to FIG. 2 and concerning a second embodiment.
Figure 9:
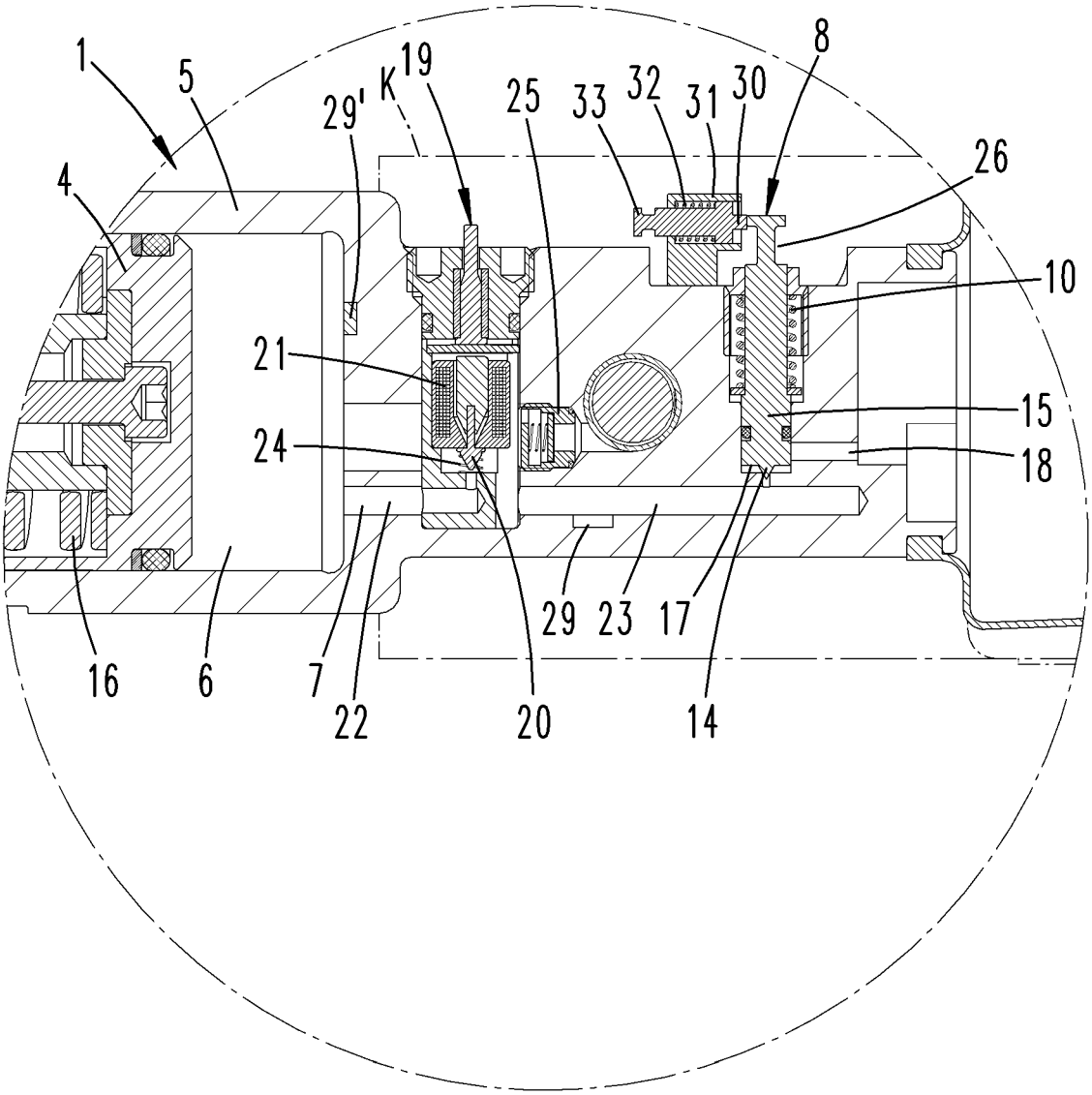
FIG. 9 shows an illustration of the second embodiment corresponding to FIG. 4.
Figure 10:
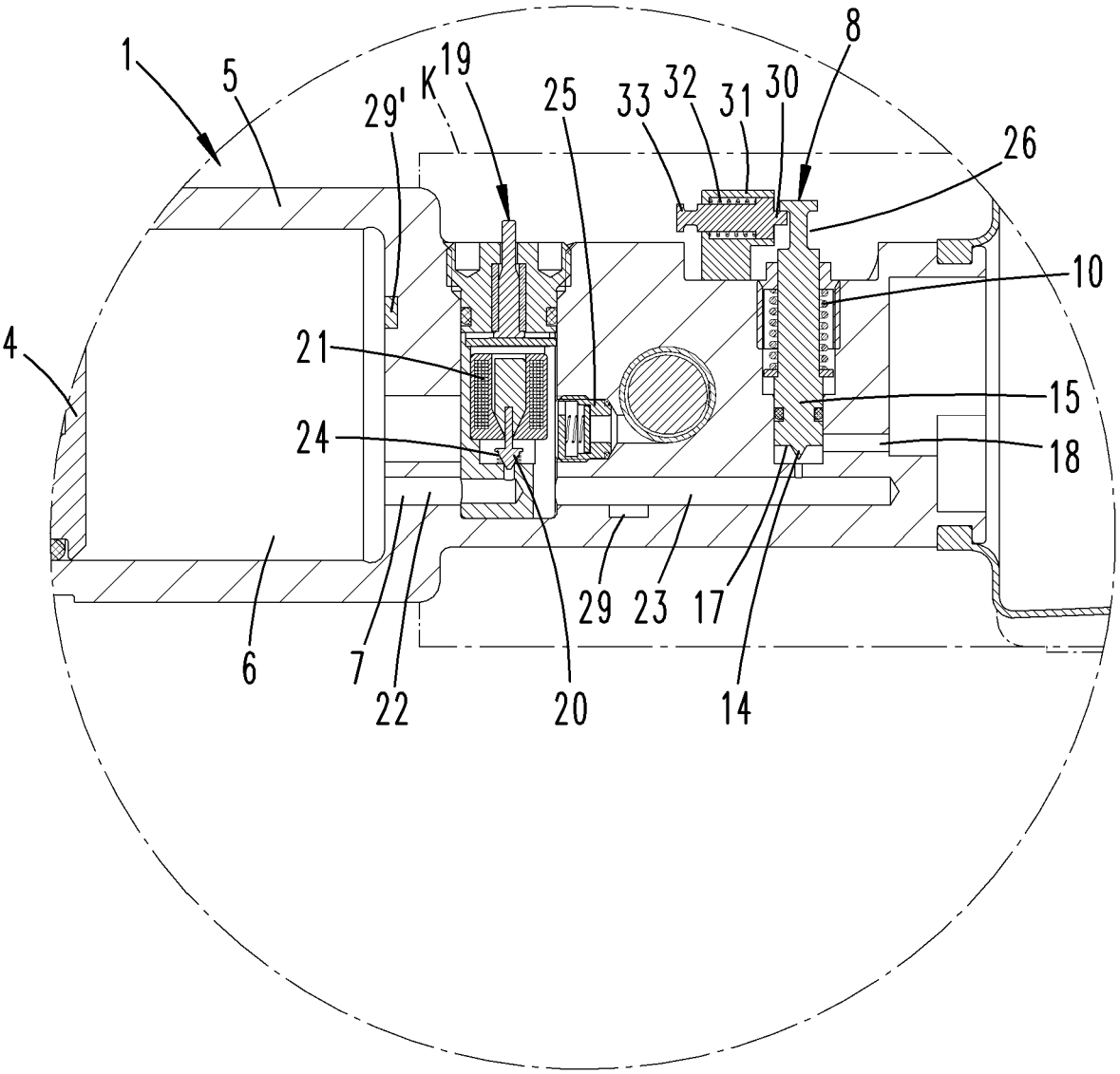
FIG. 10 shows the second embodiment in the form of an illustration according to FIG. 5.
Figure 11:
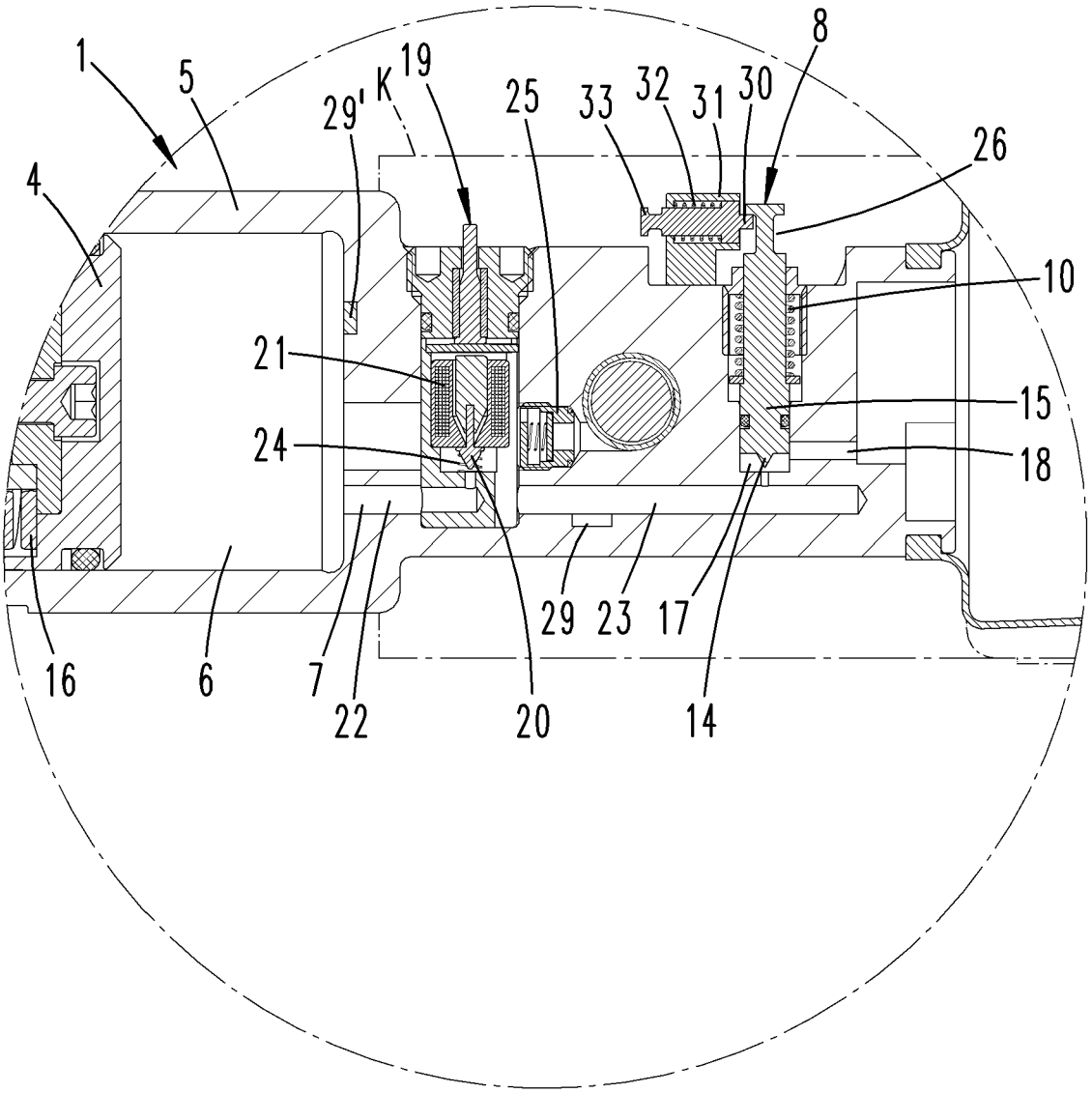
FIG. 11 shows a follow-up illustration to FIG. 10 according to FIG. 6.

According to FIGS. 4 and 7, in particular, the hydraulic chamber 6 changes with the operating state of the handheld device 1. In the illustration according to FIG. 4, the moving part 4 is in a different position than in FIG. 3. After the return valve 8 opens (FIG. 6), the hydraulic piston or the moving part 4 respectively moves back in the direction of its idle position. The hydraulic chamber 6 includes the space, which is insofar arranged upstream of the hydraulic piston, as well as the passage through the valve seat and the space directly upstream of the return valve 8 when the return valve is open.

The electric motor 2 for operating the hydraulic pump and therefore for displacing the moving part 4 in the direction of the working position is activated by means of a switch 9 that is preferably realized in the form of a hand-actuated push button. The power supply for the electric motor 2 and preferably also for switching/control electronics is realized by means of a not-shown accumulator of the device 1 or an electric line.

In the closed valve position, the return valve 8 is pressed into the valve seat by means of a pressure spring 10. The valve seat preferably consists of a screw-in part 12, which is screwed into the housing of the handheld device 1 by means of a thread 11.

A flow-through bore 13 is provided in the valve seat, if applicable in the screw-in part 12. This bore is fluidically connected to the return line 7.

Due to the narrow cross section of the flow-through bore 13 in the valve seat and the prestress generated by the pressure spring 10, the return valve 8 only opens when a defined triggering pressure is exceeded. This concerns the initially cited predefined working pressure. This triggering pressure may lie, for example, at 600 or 700 bar.

After the return valve 8 has opened, the pressure of the hydraulic medium no longer is applied to only the area corresponding to the cross-sectional area of the flow-through bore 13, namely a partial piston area that is formed, for example, by a valve needle 14, but also to the entire area (lower surface 17) of the return valve piston 15 of the return valve 8, which faces the hydraulic chamber and comprises the valve needle 14. Consequently, the opened return valve 8 is already held in the open position by a very low pressure in the return line 7, for example a pressure of 2 to 5 bar. The valve needle 14 does not have to be realized in an ideally pointed manner. In any case, it is preferably realized conically.

During the return movement of the moving part 4, this pressure is preferably generated by a spring that acts upon the moving part 4 and presses the moving part 4 into the end position.

The pressure is once again significantly lower downstream of the flow-through bore 13 in the outflow direction. At the beginning of the return movement of the moving part, in particular, this pressure only amounts, for example, to ¾ or less of the pressure upstream of the flow-through bore 13 or the valve seat, namely to about half of this pressure in practical applications. However, this pressure difference is then essentially equalized and typically only very small soon after the return movement of the moving part begins.

After the return valve 8 opens, the hydraulic chamber includes the space that is located adjacent to the flow-through bore 13 and extends up to the lower surface 17 of the return valve piston 15. The hydraulic medium then flows into the reservoir 3 through an outflow opening 18. The space is also referred to as valve chamber above and below.

Without additional measures, particularly without an external intervention, e.g., by the user, the hydraulic pressure or triggering pressure lifting the valve needle 14 off the valve seat corresponds to the aforementioned predefined working pressure on the moving part 4.

However, an option is provided for displacing the return valve 8 into its open position without applying the hydraulic pressure required for lifting the return valve 8 to the moving part 4. Accordingly, the handheld device 1 is capable of performing tasks, for example compression processes, which require lower working pressures on the moving part 4 than the triggering pressure for the return valve 8.

To this end, a blocking means 19 is provided and assigned to the hydraulic chamber arranged upstream of the return valve 8. In preferred embodiments, this blocking means 19 is realized in the form of an electrically actuatable magnetic valve.

In the illustrated exemplary embodiment, the blocking means 19 is essentially composed of a linearly displaceable blocking piston 20 with a conical blocking surface and an electrically activatable operating magnet 21.

The blocking means 19, particularly the blocking piston 20, is arranged so as to protrude into the return line 7. In its blocking position, the blocking piston 20 is suitable for dividing the return line 7 into a first line section 22 between the moving part 4 and the blocking means 19 and a second line section 23 between the blocking means 19 and the return valve 8 viewed in the backflow direction of the hydraulic medium.

In another preferred embodiment, the blocking piston 20 is prestressed from its valve seat position, in which the first line section 22 and the second line section 23 are separated, into an open position. To this end, a return spring 24, particularly in the form of a pressure spring, may be provided as shown in order to generate the corresponding prestress.

The introduction of hydraulic medium for displacing the moving part 4 forward in the direction of the working position takes place in the region of the second line section 23 while the blocking means 19 is opened. A return valve 25 is provided at this location.

The handheld device 1 preferably comprises an adjusting device 27, by means of which the maximum working pressure applied to the moving part 4 can be pre-adjusted by the user. In the illustrated exemplary embodiment, a multitude of buttons 28 are provided for this purpose, wherein predefined pressure values are respectively assigned to said buttons 28. Accordingly, the above-described selected working pressure, which is modified in comparison with the predefined working pressure (or in individual instances also corresponds thereto), can be adjusted with the adjusting device. At this point, we also refer to the other, if applicable, alternative options of the initially mentioned radio link, etc.

For example, a working pressure of 200 bar or 300 bar can be preselected for triggering the return valve.

During the course of the movement of the moving part in the direction of the working position, evaluation/control electronics evaluate pressure values measured by a pressure sensor 29, 29' and compare these pressure values with the nominal pressure value predefined by means of a button 28. The pressure sensor 29' may obviously be a pressure sensor that is directly assigned to the hydraulic chamber 6. A pressure sensor 29 may alternatively or additionally also be arranged in the return line 7 and, if applicable, in the second line section 23 as illustrated, e.g., in FIG. 4. However, since the blocking piston 20 preferably moves back into the open position automatically as described in greater detail further below and a pressure measurement is not absolutely necessary for this purpose, but the pressure sensor 29 can no longer measure the pressure in the hydraulic chamber 6 when the blocking piston 20 is in the closed position, it is preferred to provide the pressure sensor 29' that is directly assigned to the hydraulic chamber 6 in any case, particularly to provide only this pressure sensor 29'.

Once the nominal pressure value is reached, a corresponding signal is generated and leads to an activation of the operating magnet 21 of the blocking means 19.

Figure 5:
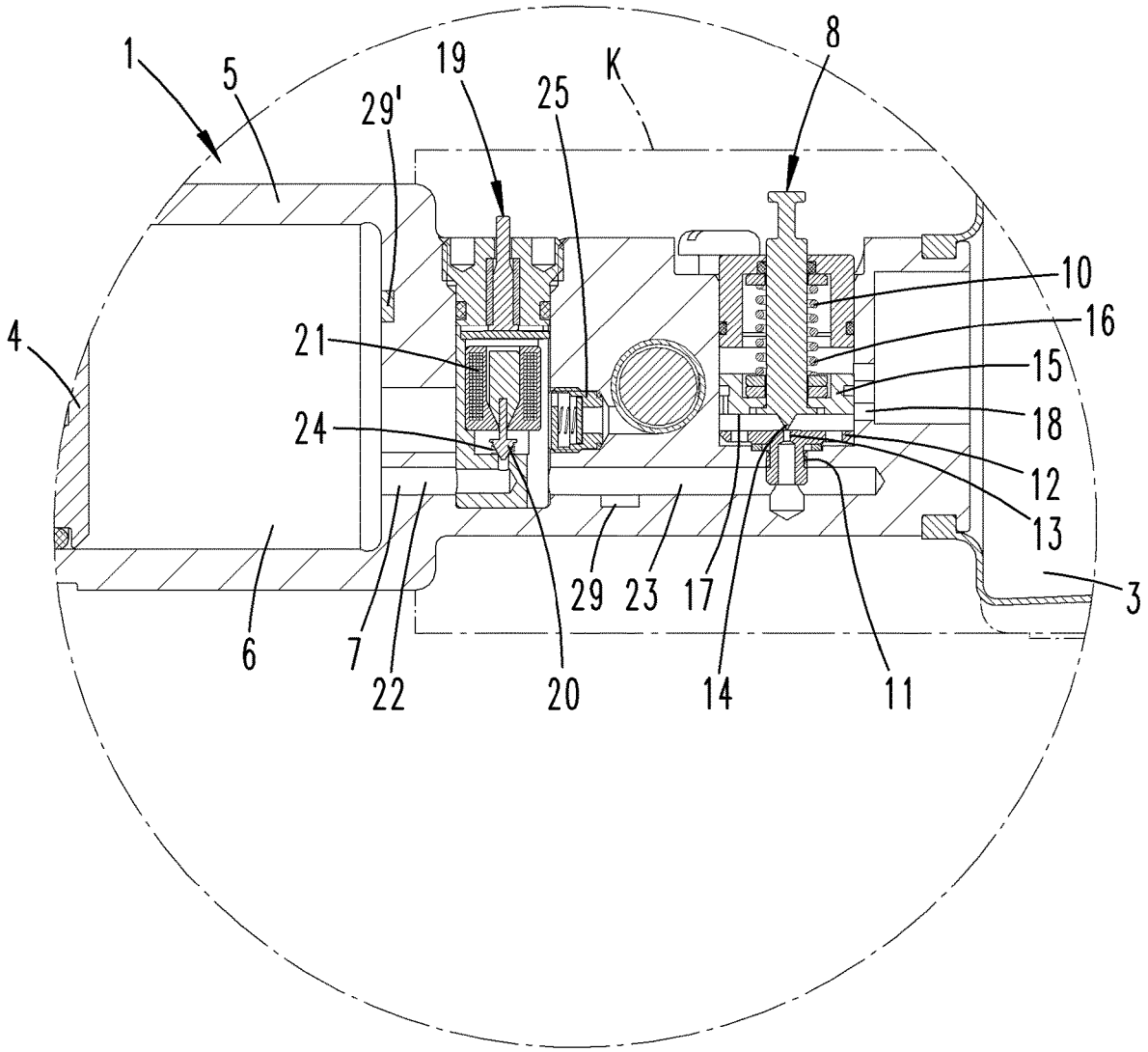
FIG. 5 shows an illustration corresponding to FIG. 4 upon reaching a pressure threshold during the course of a movement of a moving part of the handheld device into a working position.

As a result of the activation of the operating magnet 21, the blocking piston 20 abruptly moves into the forward position according to FIG. 5 against the force of the preferably provided return spring 24. In this way, the preferably conical sealing surface of the blocking piston 20 moves against the facing opening edge of the first line section 22 in a sealing manner.

The hydraulic medium, which subsequently continues to be pumped from the reservoir 3 into the second line section 23, leads to a corresponding pressure increase beyond the nominal pressure value predominating in the first line section 22. Due to the very small receiving volume for hydraulic medium, which is essentially formed by only the second line section 23, the triggering pressure for displacing the return valve 8 into the open position is particularly reached within a fraction of a second, e.g. within 2 to 5 ms (see FIGS. 5 and 6).

The operating magnet 21 of the blocking means 19 drops after the pressure-induced displacement of the return valve piston 15 into the open position. The blocking piston 20 is displaced into the open position, particularly in a spring-loaded manner, and therefore lifted off the valve seat such that the backflow of the hydraulic medium from the hydraulic chamber 6 into the hydraulic medium reservoir 3 can take place, wherein the return valve 8 is held in the raised position until the moving part 4 has reached the end position according to FIG. 3 and/or the pressure falls short of the pressure for holding open the return valve 8.

The displacement of the blocking piston 20 into the open position can be realized in different ways. The operating magnet 21 is preferably designed for acting upon the blocking piston 20 with such a low force that it is pressed into the open position due to the pressure difference between the hydraulic chamber 6 and the second line section 23, which is generated by the blocking piston 20, after the return valve 8 has opened regardless of whether the blocking piston 20 is still acted upon by the operating magnet 21. For example, this can already be realized with a pressure difference of 1 bar or more. This displacement into the open position is also desirable and required because an excessively long closed state could once again lead to the pressure falling short of the pressure, at which the return valve 8 closes, due to the outflow of the hydraulic medium in the second line section 23. It would furthermore be conceivable that the actuation of the operating magnet 21 is time-controlled. When closing of the blocking means, in this case particularly the blocking piston 20, is triggered, it would therefore be conceivable that the required actuation of the operating magnet 21 lasts for a predefined time period, which in this case preferably also lies in the range of milliseconds to tenths of a second. If the aforementioned force acting upon the blocking piston 20 is adjusted correspondingly low as it is the case in preferred embodiments, the blocking piston can already be moved back into an open position due to the aforementioned pressure difference regardless of whether it is still acted upon by the operating magnet. The opening force acting upon the blocking piston is naturally also dependent on the area, which the blocking piston blocks at the transition from the first to the second line section 22 and 23. This is accordingly also chosen such that the aforementioned opening preferably takes place automatically regardless of an actuation of the operating magnet.

The pressure increase on the return valve 8, which is realized by blocking the return line 7 with the aid of the blocking means 19, may act initially. As the return valve 8 is raised and the blocking means 19 is subsequently displaced into the open valve position, the pressure predominating due to the return movement of the moving part 4 acts upon the return valve 8.

The blocking means 19 initially may also be electrically acted upon in a pulsed manner such that the blocking piston 20 is after a complete forward stroke located in the extended position according to FIG. 5 in a virtually abrupt manner. During a regular working cycle, i.e. if the return movement of the moving part should not be prematurely terminated, the blocking piston 20 remains in the raised position, in which it respectively releases the return line 7 and connects the line sections 22 and 23.

The return line can be closed and the first and second line sections 22, 23 can thereby be separated by electrically acting upon the blocking means 20 prematurely, namely before the return movement of the moving part is completed, wherein this leads to such a pressure drop upstream of the return valve 8 in the flow direction and accordingly in the second line section 23 that the return valve 8 is thereby closed in the desired manner.

The forward movement of the moving part 4 into the working position preferably only continues as long as the user actuates the switch 9. In an embodiment, a signal is generated when the switch 9 is released (also prior to the completion of a working process) and leads to an activation of the blocking means 19 and therefore to a pressure increase in the second line section 23 upstream of the return valve 8 in the backflow direction. Accordingly, the return valve 8 is displaced into the open position when the switch 9 is released, wherein this in turn leads to an automatic return movement of the moving part 4 into the end position.

In order to reliably achieve this result although only inertial forces acting upon a pump component such as a pump piston may suffice, it is proposed that releasing the switch preferably does not lead to a standstill of the pump at exactly the same time, but the pump or a motor acting upon the pump is rather deactivated with a delay. This delay is chosen such that the required pressure increase can be achieved, i.e. in the range of a few milliseconds to tenths of a second.

The blocking piston 20 may be arranged parallel to the return valve 8. The longitudinal axes of the blocking piston 20 and the return valve 8 may therefore extend parallel to one another.

FIGS. 8 to 11 show a second embodiment of a handheld device 1. With respect to its functionality, this embodiment is to a substantial degree realized identical to the above-described first exemplary embodiment.

In this case, the handheld device 1 also comprises a return valve 8 that can be activated with a triggering pressure in order to connect the return line 7 to the hydraulic medium reservoir 3.

Furthermore, an electromagnetically actuatable blocking means 19 for acting upon the hydraulic medium volume located upstream of the return valve 8 in the backflow direction of the hydraulic medium is also provided in this case.

The blocking means 19 functions and acts as in the above-described exemplary embodiment.

The return valve 8 essentially also acts as in the above-described exemplary embodiment, particularly with respect to the triggering of the return valve S and the associated lifting of the return valve piston 15 into a position, in which it connects the return line 7 to the outflow opening 18 of the reservoir 3.

In this exemplary embodiment, it is possible to lock the raised return valve position, in which the return valve piston 15 is displaced out of the valve seat in order to release the backflow path to the reservoir 3. For this purpose, the return valve piston 15 may comprise a circumferential waist-like constriction 26 opposite of the end comprising the valve needle 14. A locking finger 30, which is spring-loaded in the locking direction, engages into the thusly formed engagement region in the raised position of the return valve piston according to FIGS. 10 and 11. In the illustrated exemplary embodiment, the locking finger 30 acts transverse to the longitudinal direction and to the displacement direction of the return valve piston 15.

The locking finger 30 is mounted in a housing section 31 in a linearly displaceable manner. In this housing section 31, a pressure spring 32 acts upon the locking finger 30, particularly such that it presses the locking finger 30 in the direction of the return valve piston 15.

An actuating section 33, which freely protrudes over the housing section 31, is integrally formed on the locking finger 30 opposite of its end that cooperates with the return valve piston 15, wherein said actuating section makes it possible to move the locking finger 30 back as a result of a pulling movement against the effect of the pressure spring 32 in order to thereby release the return valve piston 15. Due to the effect of the pressure spring 10, the return valve piston drops back into the valve seat position, in which the backflow path is blocked.

In this embodiment, the return valve piston 15 preferably also can only drop back into the valve seat position once the hydraulic pressure acting upon the overall piston area has dropped to a level that allows this displacement of the piston into the valve seat position. This can be realized upon completion of the return movement of the moving part 4 into a home position or by activating the blocking means 19 during the course of the return movement of the moving part 4, wherein a pressure reduction, which allows the displacement of the return valve piston 15 back into the valve seat position, is in the latter case also adjusted in the second line section 23 if the return movement of the moving part 4 has not been completed as a result of blocking the return line 7.

The preceding explanations serve for elucidating all inventions that are included in this application and respectively enhance the prior art independently with at least the following combinations of characteristics, namely:

A method, which is characterized in that the hydraulic pressure acting upon the return valve 8 for triggering a movement of the moving part 4 into the end position is increased by means of a separately triggerable pressure increase, which results in opening of the return valve 8, in a hydraulic medium volume located upstream of the return valve 8 in a flow direction of the hydraulic medium during the movement into the end position.

A method, which is characterized in that the hydraulic pressure acting upon the return valve 8 is decreased by means of a separately triggerable pressure decrease, which results in closing of the return valve 8, in a hydraulic medium volume located upstream of the return valve 8 in a flow direction of the hydraulic medium during the movement into the end position.

A method, which is characterized in that a line section upstream of the return valve 8 in the aforementioned flow direction is blocked or restricted in order to achieve the pressure decrease.

A method, which is characterized in that a line section upstream of the return valve 8 in the aforementioned flow direction is blocked or restricted and hydraulic medium is introduced into the thusly blocked or restricted line section in order to achieve a pressure increase.

A method, which is characterized in that the hydraulic medium pump delivers into a second line section 23, through which the hydraulic medium flowing in the open state of the return valve 8 also flows.

A method, which is characterized in that the second line section 23 is blocked in order to achieve the pressure increase.

A handheld device, which is characterized in that the hydraulic pressure acting upon the return valve 8 for triggering a movement of the moving part 4 into the end position can be increased by means of a separately triggerable pressure increase, which results in opening of the return valve 8, in a hydraulic medium volume located upstream of the return valve 8 in a flow direction of the hydraulic medium during the movement into the end position.

A handheld device, which is characterized in that the hydraulic pressure acting upon the return valve 8 can be decreased by means of a separately triggerable pressure decrease, which results in closing of the return valve 8, in a hydraulic medium volume located upstream of the return valve 8 in a flow direction of the hydraulic medium during the movement into the end position.

A handheld device, which is characterized in that a line section upstream of the return valve 8 in the aforementioned flow direction can be blocked or restricted in order to achieve the pressure decrease.

A handheld device, which is characterized in that a line section upstream of the return valve 8 in the aforementioned flow direction can be blocked or restricted and hydraulic medium can be introduced into the thusly blocked or restricted line section in order to achieve a pressure increase.

A handheld device, which is characterized in that the hydraulic medium pump delivers into a second line section 23, through which the hydraulic medium flowing in the open state of the return valve 8 can also flow.

A handheld device, which is characterized in that the second line section 23 can be blocked in order to achieve the pressure increase.

A handheld device, which is characterized in that the blocking means 19 is prestressed into an open position.

A handheld device, which is characterized in that the blocking means 19 consists of a magnet-actuated closing means.

All disclosed characteristics are essential to the invention (individually, but also in combination with one another). The disclosure content of the associated/attached priority documents (copy of the priority application) is hereby fully incorporated into the disclosure of this application, namely also for the purpose of integrating characteristics of these documents into claims of the present application. The characteristic features of the dependent claims characterize independent inventive enhancements of the prior art, particularly for submitting divisional applications on the basis of these claims.

LIST OF REFERENCE SYMBOLS

1 Handheld device
2 Electric motor
3 Hydraulic medium reservoir
4 Moving part
5 Fixed part
6 Hydraulic chamber
7 Return line
8 Return valve
9 Switch
10 Pressure spring
11 Thread
12 Screw-in part
13 Flow-through bore
14 Valve needle
15 Return valve piston
16 Spring
17 Lower surface
18 Outflow opening
19 Blocking means
20 Blocking piston
21 Operating magnet
22 First line section
23 Second line section
24 Return spring
25 Return valve
26 Constriction
27 Adjusting device
28 Button
29 Pressure sensor
29' Pressure sensor
30 Locking finger
31 Housing section
32 Pressure spring
33 Actuating section
K Device body

The invention claimed is:

1. A method comprising:

providing a hydraulically operated handheld device including a reservoir, a hydraulic pump for pumping hydraulic medium from the reservoir, a moving part, a hydraulic chamber, a fixed part and a return valve with an associated valve seat, the moving part being movable relative to the fixed part;

pumping hydraulic medium from the reservoir into the hydraulic chamber thereby causing a build-up of hydraulic pressure in the hydraulic chamber and causing the moving part to move into a working position; and causing an increase of hydraulic pressure acting to open the return valve at a hydraulic pressure in the hydraulic chamber below a predetermined working pressure which would cause the return valve to automatically open and automatically moving the moving part from the working position into an end position, and wherein the hydraulic pressure acting upon the return valve for causing movement of the moving part into the end position is in a hydraulic medium volume located upstream of the return valve in a flow direction of the hydraulic medium flowing during the movement of the moving part into the end position.

2. The method according to claim 1, further comprising decreasing the hydraulic pressure acting upon the return valve thereby closing the return valve.

3. The method according to claim 2, wherein the hydraulic pressure decrease is affected by opening a line section upstream of the return valve.

4. The method according to claim 1, wherein the hydraulic pressure increase acting on the return valve is partially affected by blocking or restricting a line section upstream of the return valve.

5. The method according to claim 4, wherein the hydraulic pressure increase acting on the return valve is further affected by pumping hydraulic medium into a line section between the pump and the return valve.

6. A hydraulically operated handheld device comprising:

a hydraulic pump;

a reservoir;

a moving part;

a hydraulic chamber;

a fixed part; and a return valve with an associated valve seat, wherein the moving part can be moved into a working position due to a build-up of a hydraulic pressure by filling the hydraulic chamber with hydraulic medium from the reservoir using the hydraulic pump, wherein the moving part can be automatically moved back from the working position into an end position upon reaching a predefined working pressure by opening the return valve, and wherein the hydraulic pressure acting upon the return valve for triggering a movement of the moving part into the end position can be increased by a separately triggerable pressure increase, which results in opening of the return valve, in a hydraulic medium volume located upstream of the return valve in a flow direction of the hydraulic medium flowing during the movement of the moving part into the end position.

7. The handheld device according to claim 6, wherein the hydraulic pressure acting upon the return valve can be decreased by a separately triggerable pressure decrease, which results in closing of the return valve, in the hydraulic medium volume located upstream of the return valve in a flow direction of the hydraulic medium during the movement into the end position.

8. The handheld device according to claim 7, further comprising a line section upstream of the return valve in the flow direction, wherein the line section can be blocked or restricted in order to achieve the pressure decrease.

9. The handheld device according to claim 6, further comprising a line section upstream of the return valve in the flow direction, wherein the line section can be blocked or restricted and hydraulic medium can be introduced into the blocked or restricted line section to achieve a pressure increase.

10. The handheld device according to claim 6, further comprising a second line section, wherein the hydraulic pump pumps hydraulic medium into the second line section when the return valve is in an open position of the return valve.

11. The handheld device according to claim 10, wherein the separately triggerable pressure increase is affected by blocking the second line section.

12. The handheld device according to claim 6, wherein a blocking means which affects the separately triggerable pressure increase is prestressed into an open position.

13. The handheld device according to claim 12, wherein the blocking means comprises a magnet-actuated piston.

14. A hydraulically operated handheld device comprising:

a body;

a reservoir within the body and configured to hold hydraulic medium, the reservoir including a first return valve which only allows fluid to flow out of the reservoir;

a moving part comprising a hydraulic piston movably mounted in a cylinder, the cylinder being mounted to the body, wherein the piston and the cylinder define a hydraulic chamber into which hydraulic medium can flow into or out of;

a first fluid line between the first return valve and the hydraulic chamber which allows for flow of hydraulic medium from the reservoir to the hydraulic chamber;

a displaceable piston within the body, the displaceable piston being movable into the first fluid line, wherein the first fluid line is blocked or restricted when the displaceable piston is displaced into a closed position to prevent fluid flow along the first fluid line and to separate the first fluid line into a first line section and a second line section, the second line section always being flow connected to the first return valve, and the first fluid line is open when the displaceable piston is displaced into an open position to allow fluid flow along the first fluid line;

a second fluid line between the second line section and the reservoir, the second fluid line always being flow connected to the second line section;

a second return valve within the body, the second return valve being movable into the second fluid line, wherein the second fluid line is blocked when the second return valve is displaced into a closed position to prevent fluid flow along the second fluid line, and the second fluid line is open when the second return valve is displaced into an open position to allow fluid flow along the second fluid line; and a hydraulic pump for pumping hydraulic medium from the reservoir to the first and second fluid lines.

15. The handheld device according to claim 14, further comprising an electrically actuatable magnet which is activatable to cause displacement of the displaceable piston into the closed position.

16. The handheld device according to claim 15, further comprising a pressure sensor which measures pressure in the hydraulic chamber.

17. The handheld device according to claim 16, further comprising a second pressure sensor which measures pressure in in the second fluid line.

18. The handheld device according to claim 15, further comprising a pressure spring which acts on the displaceable piston to bias the displaceable piston into the open position.

19. The handheld device according to claim 14, wherein the second return valve includes a piston which can be seated within a valve seat of the body, wherein the piston of the second return valve is biased into engagement with the valve seat by a pressure spring.

20. The handheld device according to claim 14, further comprising a spring which acts on the hydraulic piston of the moving part against a pressure build-up in the hydraulic chamber.

* * * * *